US008480546B2

(12) United States Patent
Spencer

(10) Patent No.: US 8,480,546 B2
(45) Date of Patent: Jul. 9, 2013

(54) SPEED DOCTOR SPEED BUILDER

(76) Inventor: Clevon Spencer, Moreno Valley, CA (US)

( * ) Notice: Subject to any disclaimer, the term of this patent is extended or adjusted under 35 U.S.C. 154(b) by 565 days.

(21) Appl. No.: 12/776,953

(22) Filed: May 10, 2010

(65) Prior Publication Data

US 2010/0304937 A1 Dec. 2, 2010

Related U.S. Application Data

(60) Provisional application No. 61/182,866, filed on Jun. 1, 2009.

(51) Int. Cl.
*A63B 21/00* (2006.01)

(52) U.S. Cl.
USPC ..... 482/74; 482/44; 482/79

(58) Field of Classification Search
USPC ..... 482/79, 74
See application file for complete search history.

(56) References Cited

U.S. PATENT DOCUMENTS

| | | | | | |
|---|---|---|---|---|---|
| 2,439,100 | A | * | 4/1948 | Richards | 602/28 |
| 4,033,581 | A | | 7/1977 | Sheppard | |
| 4,329,982 | A | | 5/1982 | Heaney | |
| 4,371,161 | A | | 2/1983 | Williams | |
| 4,566,447 | A | | 1/1986 | Deis | |
| 4,869,499 | A | | 9/1989 | Schiraldo | |
| 4,955,370 | A | | 9/1990 | Pettina | |
| 5,215,508 | A | | 6/1993 | Bastow | |
| 5,277,699 | A | | 1/1994 | Williamson | |
| 5,291,904 | A | | 3/1994 | Walker | |
| 5,382,224 | A | | 1/1995 | Spangler | |
| 5,399,155 | A | | 3/1995 | Strassburg et al. | |
| 5,700,232 | A | * | 12/1997 | Clausen et al. | 482/125 |
| 5,860,423 | A | * | 1/1999 | Thompson | 128/882 |
| 6,503,178 | B1 | | 1/2003 | Gibbons | |
| 6,602,217 | B2 | | 8/2003 | Crawford | |
| 6,790,165 | B2 | | 9/2004 | Huang | |
| D514,225 | S | | 1/2006 | Sassi | |
| 7,458,950 | B1 | | 12/2008 | Ivany | |
| 7,611,477 | B2 | | 11/2009 | Dauhoff et al. | |
| 7,674,212 | B2 | | 3/2010 | Kruijsen et al. | |
| 2005/0070833 | A1 | | 3/2005 | Shields | |

* cited by examiner

*Primary Examiner* — Jerome w Donnelly
(74) *Attorney, Agent, or Firm* — Kirk A. Buhler; Buhler & Associates

(57) ABSTRACT

Improvements in a foot exerciser are presented that provides variable resistance for foot extension and flexing. The improvements are presented with two varieties where a first variety is fit onto an existing shoe and a second variety that is a complete shoe with the resistance elements built into or on the shoe. The amount of resistance can be changed or varied based on the abilities of the athlete by changing the resistance material, length, number and or the attachment location of the resistance element on the shoe or foot exerciser. The Speed Doctor speed builder foot exerciser provide athletes with a simple and effective way to improve the strength, agility and jumping ability of their legs by wearing shoes that offer resistance and tension.

9 Claims, 4 Drawing Sheets

SPEED DOCTOR SPEED BUILDER

CROSS REFERENCE TO RELATED APPLICATION

This application claims the benefit of Provisional 61/182,866 filed Jun. 1, 2009 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in an exercise device that strengthens the calf muscle. More particularly, the present device is a shoe with flexible straps that provide flexing resistance to an ankle. Another embodiment connects to an existing shoe to provide the same flexing resistance.

2. Description of Related Art Including Information Disclosed Under 37 CFR 1.97 and 1.98

Athletes are always looking for new ways to increase their speed, agility and overall leg strength. Some may utilize certain exercises to improve their strength, but these items may not offer tension to really work the muscles. Weight equipment may help with one's strength, but may not offer help with agility or jumping abilities. Fitness apparatuses may also be expensive and bulky for one to store. Having a simple way to increase one's leg strength, agility and jumping ability in a simple way while performing a traditional workout routine may assist individuals in seeing results in a timely manner with little effort.

Several products and patents have been issued on products that are design to exercise the calf muscle of athletes. Exemplary examples of patents covering these products are disclosed herein.

U.S. Pat. No. 4,371,161 issued Feb. 1, 1983 to Victor N. Williams discloses an Ankle and Foot Exercise Apparatus. This invention uses a base plate that is secured to the front of the lower leg and a strap that is wrapped around the foot of the user. A length of surgical hose is then connected between the two components. While this patent provides some exercise to the ankle and the foot, the amount of resistance is not variable and the device is not configured for use while an athlete is competing.

U.S. Pat. No. 6,503,178 issued Jan. 7, 2003 to Vincent B. Gibbons discloses a Calf Master device. This patent discloses a device that clamps onto a foot or shoe with a number of rigid components and forces the ankle to pivot in a specific and possibly unnatural location. The rigid nature of the device can be uncomfortable for the user to wear and can result in harm to the user. While the device allows a user to install one or more bands to change the resistance the bands all connect linearly in front of the foot and can restrict movement. This patent does not allow for connecting the resistance bands at different locations on the device and more particularly on the outsides of the device to provide side to side resistance and further leaving the front of the device open for kicking balls and the like.

What is needed is an ankle and foot exercise device that is available for use with both an existing shoe and as a shoe that allows maximum versatility of the device while allowing a user to perform in a sport.

BRIEF SUMMARY OF THE INVENTION

It is an object of the speed doctor speed builder foot exerciser to be worn by individuals that wish to increase the strength in their legs by wearing specialized shoes that utilize resistance bands for tension. The use of one or multiple resistance bands allows the foot exerciser to be used by a wide range of individuals including but not limited to athletes.

It is an object of the speed doctor speed builder foot exerciser to be utilized by athletes to increase their speed and jumping ability by working core muscles with every motion their legs make. These innovative items are ideal for people that are beginning an exercise routine to seasoned athletes that are looking to further improve their performance abilities by improving strengthening their calf muscles to improve speed and jumping.

It is an object of the speed doctor speed builder foot exerciser to be used by anyone looking for a simple way to improve their speed, agility and jumping ability by wearing specialized footwear that offers resistance during training sessions.

It is another object of the speed doctor speed builder foot exerciser for the exerciser to be configured to fit on an existing shoe. When the foot exerciser is configured to fit onto an existing shoe the athlete has the ability use specific sport shoes that may have cleats or spikes. This allows an athlete to transfer the foot exerciser to each of the different shoe that they wear both on and off of the practice field.

It is another object of the speed doctor speed builder foot exerciser to be configured as a shoe and to be available in a variety of sizes. When the foot exerciser is configured as a shoe the foot exerciser can be configured with a variety of different configuration depending upon the sport. These configurations can include but not be limited to the sole pattern as well as cosmetic or ornamental appearance of the shoe.

It is still another object of the speed doctor speed builder foot exerciser for the exerciser to have resistance straps that extend from each side of the device. Having separate straps for each side of the foot exerciser provides not only resistance for foot flexing, but also provides resistance from side to side tipping of the foot thereby allowing an athlete to rotate a foot to exercise the foot for lateral movement.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
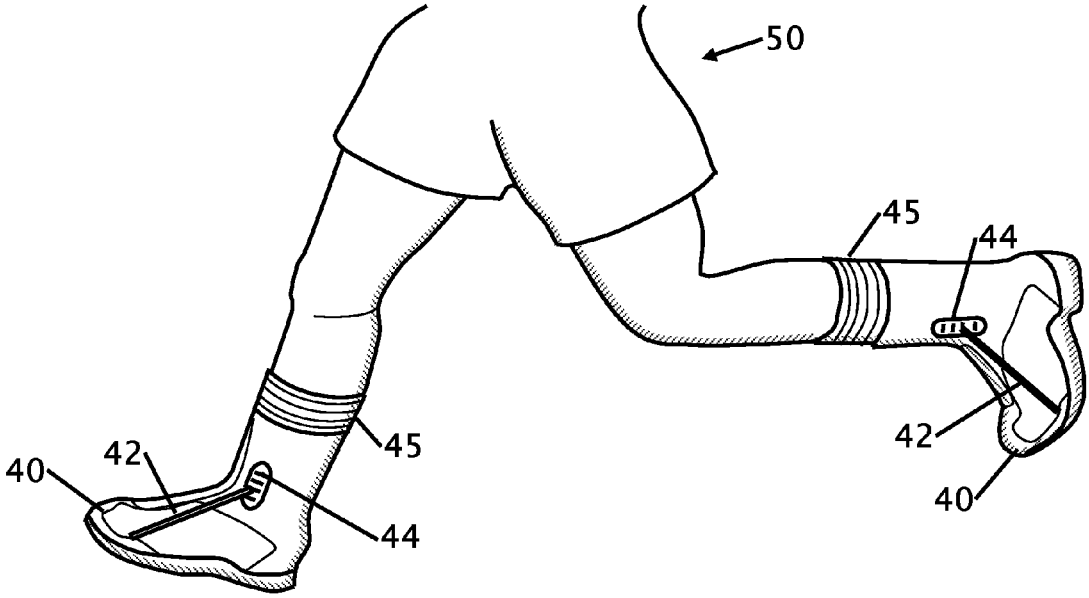
FIG. 1 shows a perspective view of the speed doctor speed builder foot exercisers on an athlete.

FIG. 1 shows a perspective view of the speed doctor speed builder foot exercisers on an athlete. The Speed Doctor speed builder provides athletes 50 with a simple and effective way to improve the strength, agility and jumping ability of their legs by wearing shoes that offer resistance and tension. These products may look like a high-top wrestling or boxing shoe. They may be form fitting with the sole of a cross-training athletic shoe. The sole 40 of the shoe may vary to accommodate individual sports, such as a cleat sole for football and baseball. Resistance bands 42, which may vary in tension level, may affix to the left and right side of the upper shin area of the shoe by small hooks 44, or by another similar method. This resistance technology may be ideal for speed training due to the fact that the energy that is stored in the resistance bands 42 is much greater than gravitational energy used by weights. This allows for the reaction of a stretched band to be transferred to the muscles for greater acceleration of muscle reaction time, thus creating a faster reaction in muscle fibers. A strap 45 at the top of the shoe may utilize hook and loop fasteners, as well as thick shoelaces, to secure the article in place. Shoes may also be comfortably worn without the resistance bands if desired.

These shoes may be produced from mesh, rubber, plastic, braided steel and similar, durable materials. This item may be produced in various colors and sizes to accommodate use preferences. This product can be adjustable to suit user needs. The exact dimensions, materials used for construction and method of operation of The Speed Doctor speed builder may vary upon manufacturing.

Figure 2:
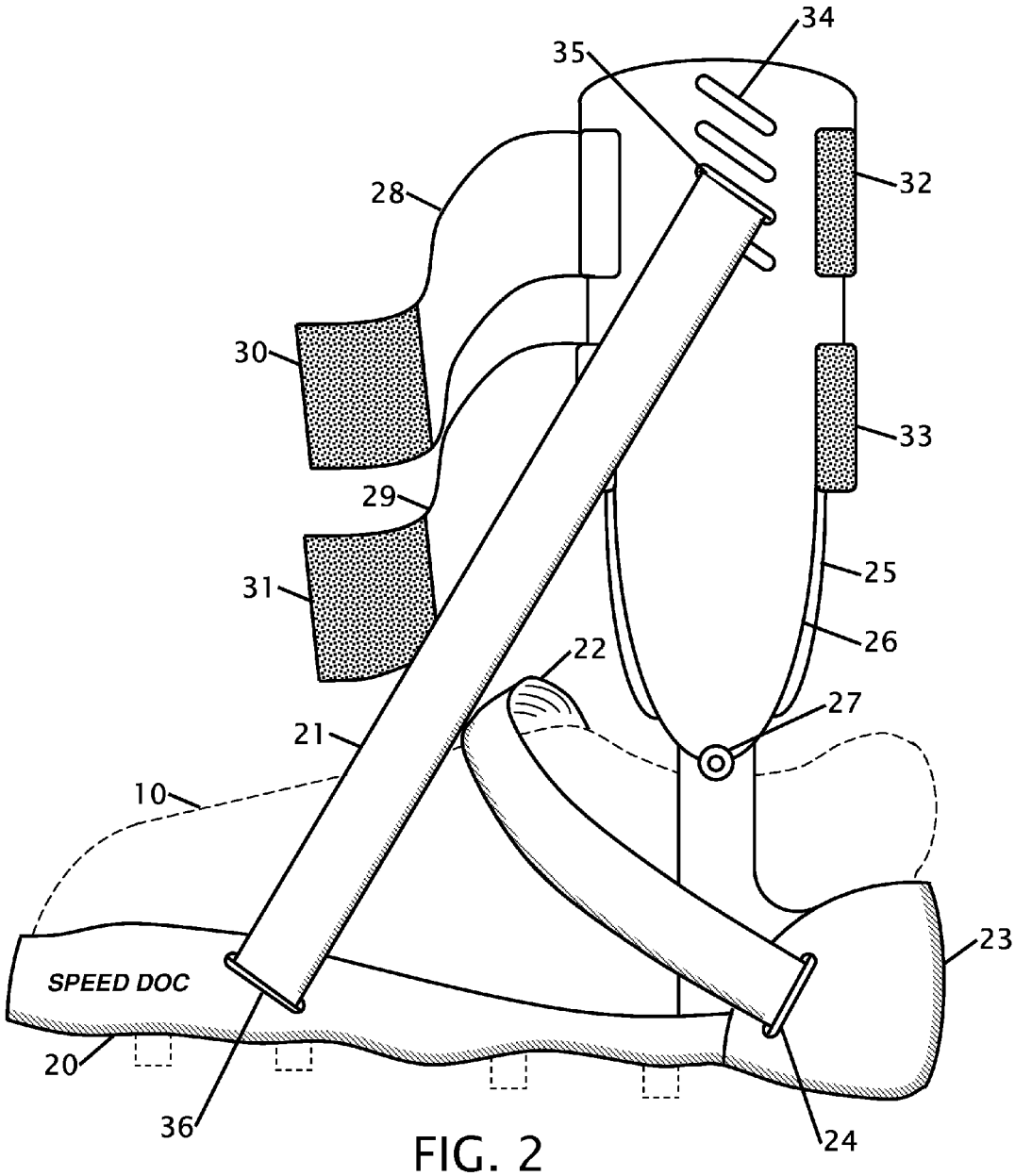
FIG. 2 shows a side view of the foot exerciser configured to fit onto an existing shoe.

FIG. 2 shows a side view of the foot exerciser configured to fit onto an existing shoe 10. This configuration of the foot exerciser is manufactured in various sizes to accommodate different length and width exercise shoes 10. An exercise shoe 10 is placed inside the bottom sole 20 and is secured with a strap 22 that holds the foot and the shoe 10 within the foot exerciser for added security. The strap 22 pulls the shoe 10 into the heal 23 of the foot exerciser. The strap 22 is secured in a binding hole 24 or is secured with hook and loop fasteners. A support connects the bottom portion to the top portion of the foot exerciser through a pivot 27 that allows for ease of foot movement, pivoting and support. While only one side of the foot exerciser and only one pivot 27 is shown it should be understood that a complementary pivot exists on both sides of the foot exerciser and therefore both sides of the shoe 10 and a foot placed within the shoe 10. The pivot 27 connects the bottom portion with the top portion.

The top portion has side supports 26 that are preferably made with a semi rigid plastic or similar material. The side supports further include a cushioning material 25. That pads the leg of a user from the side supports 26. One or more straps 28 and 29 have hook and loop fasteners 30 and 31 that engage in complimentary hook and loop fasteners 32 and 33 to secure the top portion onto the leg of an athlete. While hook and loop fasteners are shown and described other fastening systems are contemplated that will provide similar or equivalent performance. It is also contemplated that the straps 28 and 29 be made from a flexible and or stretchable material. The side supports 26 have a plurality of slots 34 where an elastic strap 21 is secured at each end 35 and 36. The plurality of slots 34 allows the strap 21 to be placed in a variety of positions to alter the tension on the strap 21. While four slots 34 are shown in this figure it is contemplated that as few as one or many more than the four slots shown can be used. The lower portion shows a single slot 36 but may also include a plurality of connecting slot locations.

In this preferred embodiment, the inside of the bottom sole 20 is open and allows the bottom of the shoe 10 to extend out the bottom of the foot exerciser sole 20.

This allows the bottom features of the shoe 10 to be used. The bottom features may include cleats, spikes or other topography.

Figure 3:
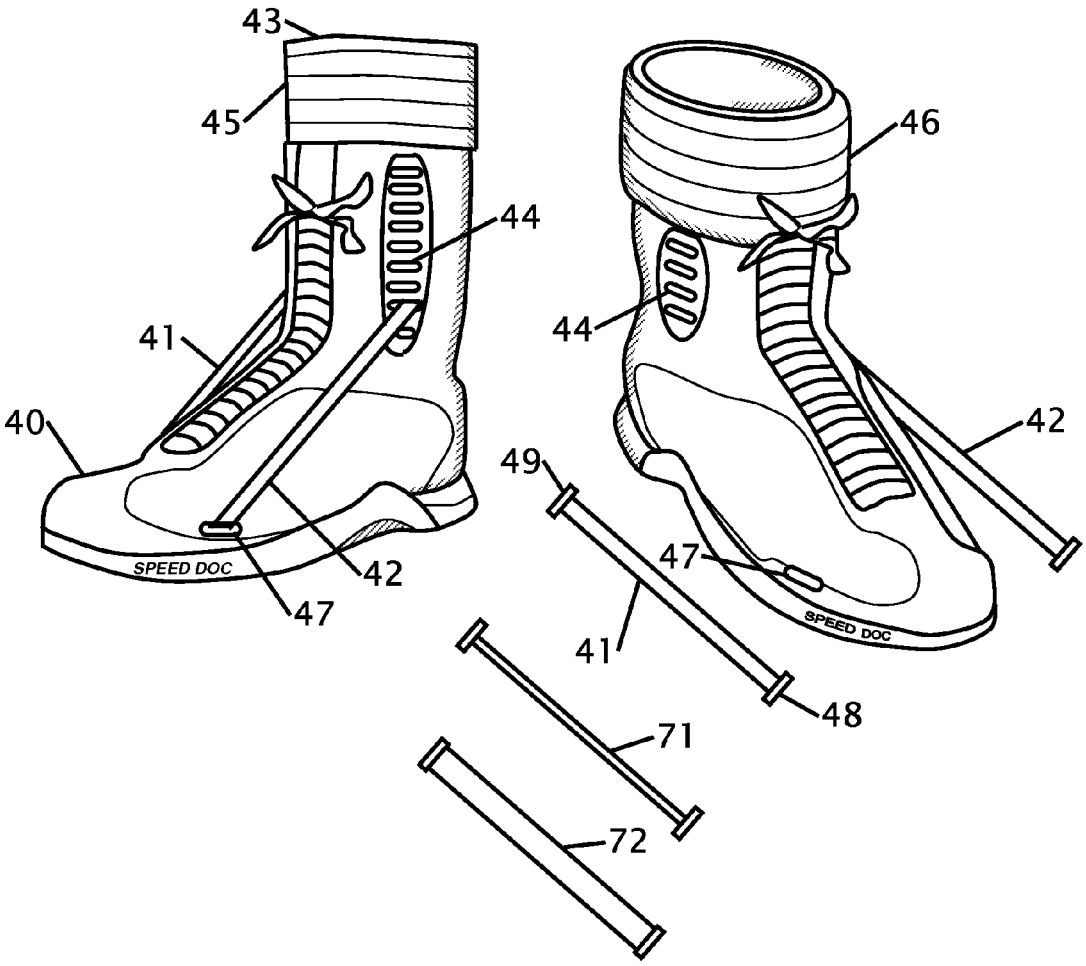
FIG. 3 shows a perspective view of the foot exerciser configured as a pair of shoes with the various components.

FIG. 3 shows a perspective view of the foot exerciser configured as a pair of shoes with the various components. The top of the shoe 40 is configured in a Hi-Top configuration t allow for the vertical height that is needed to support the elastic straps 42 in the connecting slots 44. Each shoe has a separate strap 41 and 44 located on each side of the shoe. Each strap can be individually changed and or connected into the same or different slot 44 in the shoe. Each strap has an outer end 48 and 49 with ears that retain the strap in the slot 44 and 47. This figure shows straps 41, 42, 71 and 72 that are made with different widths of material to alter the resistance. The elastic strap has a shore A durometer of between 20 and 90 depending upon the desired amount of resistance. While one method of changing the resistance is by altering the cross section of the resistance band and or changing the material The top 45 of the exercise shoe has an inner foam layer 43 for absorption and to reduce rubbing friction. In the left exercise shoe the foam layer is shown raised and in the right exercise shoe the foam layer is shown rolled over 46 the top of the exercise shoe to reduce the profile of the exercise shoe. In the figure the top portion is secured to the ankle of an athlete using laces, but other similar methods are contemplated including but not limited to hook and loop fasteners or equivalent.

Figure 4:
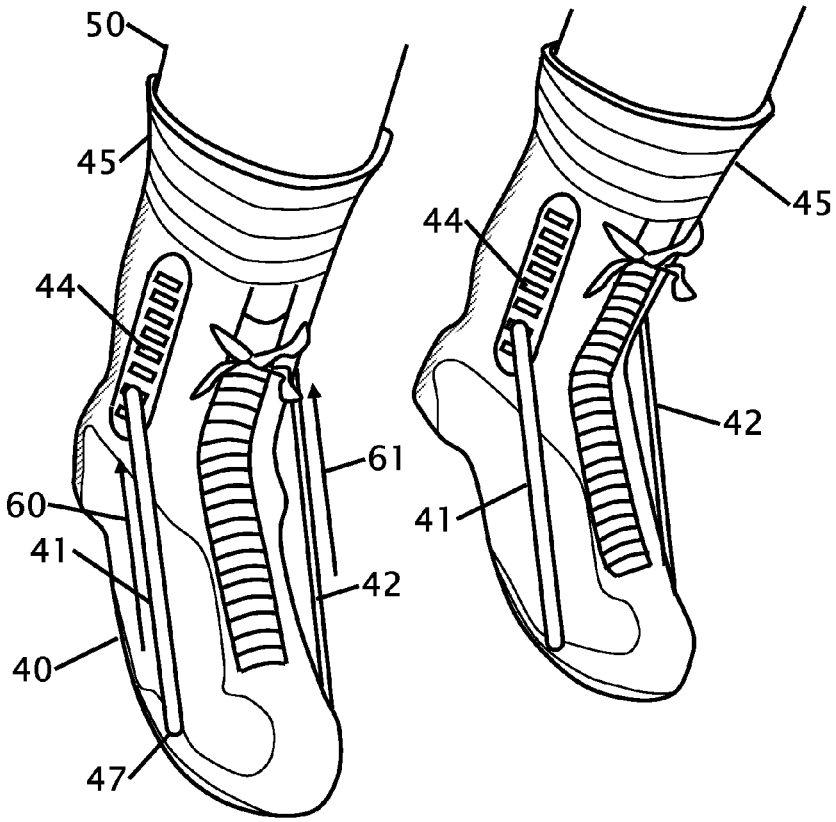
FIG. 4 shows the foot exerciser configured as shoes on an athlete jumping to show the flexing of the bands.

FIG. 4 shows the foot exerciser configured as shoes on an athlete jumping to show the flexing of the bands. Because there are separate bands 41 and 42 on each side of the exercise shoe 40 each side can have the same or different tensions. The separate bands allow an athlete to further strengthen their ankle by providing side to side flexing resistance. In this figure the athlete 50 is shown in a jumping orientation. When the athlete 50 jumps, the athlete must both overcome their own weight but must also overcome the pull 60 and 61 of the resistance bands 41 and 42. Each shoe has a separate strap 41 and 44 located on each side of the shoe. Each strap can be individually changed and or connected into the same or different slot 44 in the shoe. Each strap has an outer end 48 and 49 with ears that retain the strap in the slot 44 and 47. The top 45 of the exercise shoe has an inner foam layer for absorption and to reduce rubbing friction.

Thus, specific embodiments of a foot exerciser have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A foot exerciser comprising:

an athletic shoe having a bottom portion configured to accept a foot of a user and a top section configured to be secured on an ankle of said user;

said top portion further includes a slot for connection of a resistance band;

said bottom portion has a slot for a resistance band;

a resistance band that is securable between said slot in said top portion and said slot in said bottom portion, and wherein a bottom of said bottom portion has topography for cleats or spikes.

2. The foot exerciser according to claim 1 wherein said resistance bands further have a plurality of ears that extends from sides of said resistance bands.

3. The foot exerciser according to claim 1 wherein said resistance bands are made from rubber.

4. The foot exerciser according to claim 3 wherein said resistance band has a shore A durometer of between 20 and 90.

5. The foot exerciser according to claim 4 wherein said resistance band is fabricated with different cross sectional areas.

6. The foot exerciser according to claim 1 wherein said top portion is secured to a leg of said user with laces, or straps having hook and loop fasteners.

7. The foot exerciser according to claim 6 wherein both sides of said top portion have separate for connection of separate resistance bands on sides of said foot exerciser.

8. The foot exerciser according to claim 1 wherein said top portion has a plurality of slots.

9. The foot exerciser according to claim 8 wherein said resistance band can be placed in different said plurality of slots to alter a flexing resistance.

* * * * *